United States Patent [19]

Hyman

[11] 4,116,108

[45] Sep. 26, 1978

[54] MUSICAL TUBE

[76] Inventor: Jeffrey M. Hyman, 58 Morton St., Newton Centre, Mass. 02159

[21] Appl. No.: 756,262

[22] Filed: Jan. 3, 1977

[51] Int. Cl.[2] ..... G10D 7/00; G10D 7/12

[52] U.S. Cl. ..... 84/330; 46/52; 84/375

[58] Field of Search ..... 46/52, 180; 84/330, 84/375

[56] References Cited

U.S. PATENT DOCUMENTS

| | | | |
|---|---|---|---|
| 2,637,141 | 5/1953 | De Nisco | 46/52 |
| 4,034,499 | 7/1977 | Wild | 46/52 |

OTHER PUBLICATIONS

"Singing Corrugated Pipes", Frank S. Crawford, American Journal of Physics, vol. 42, Apr. 1974, pp. 278–288.

*Primary Examiner*—Lawrence R. Franklin
*Attorney, Agent, or Firm*—Herbert L. Gatewood

[57] ABSTRACT

The invention disclosed is a new and improved musical tube which can be used as a musical instrument or merely as a toy or a noise maker. The musical tube comprises in its basic aspects an elongated, flexible, open-ended, cylindrical tube having a non-smooth inner circumferential surface and a handle portion specifically delimited at one end. The invention in a further aspect comprises such a musical tube in combination with another musical instrument such as a reed.

12 Claims, 9 Drawing Figures

FIG. 6
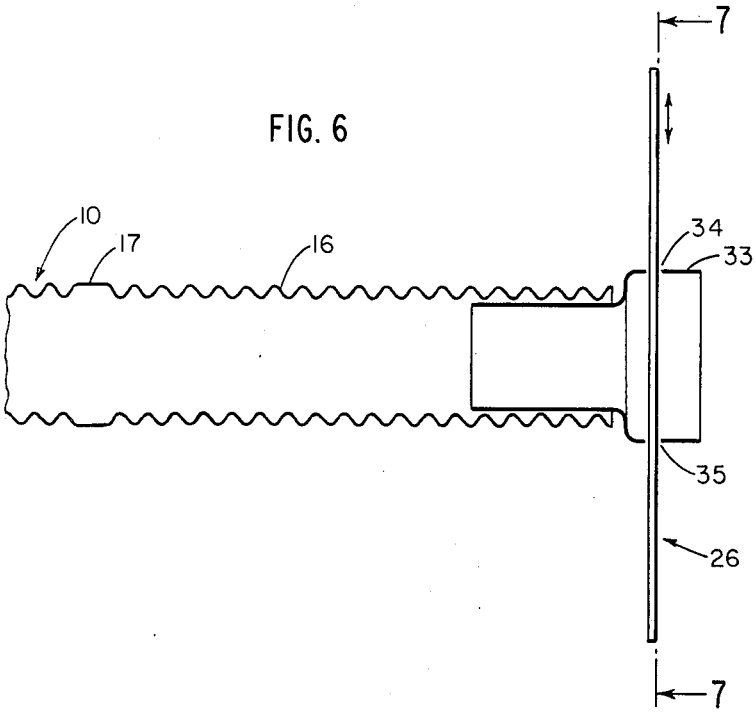
FIG. 7
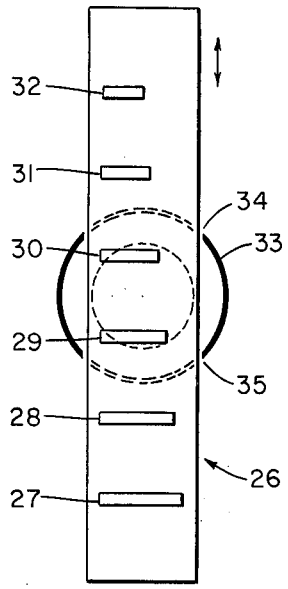
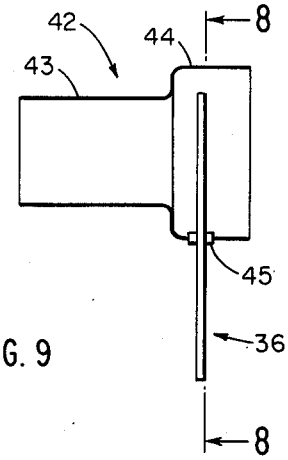
FIG. 9
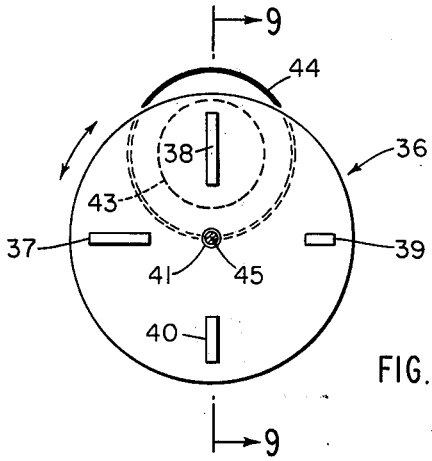
FIG. 8

MUSICAL TUBE

BACKGROUND OF THE INVENTION (A) Field of the Invention

The invention relates to a new and improved musical tube for the production of musical tones and to the combination of the musical tube with a musical reed.

(B) Description of the Prior Art

In U.S. Pat. No. 2,637,141, there is disclosed a musical toy that comprises a cylindrical air chamber at one end of which is attached a handle for rotation of the cylinder. Internally of the air cylinder, and intermediate the ends thereof, is located a resistance or musical instrument such as a reed which causes the production of sound or music similar to a musical wind instrument, when the air cylinder is rotated in a plane.

More recently, there has been introduced a musical tube of flexible, corrugated plastic which, when swung around in the air, produces an agreeable warbling howl. Such a musical tube is disclosed in published German Patent Application Ser. No. 2,121,568. Tubes of the type disclosed in the German Patent Application, except that they do not have a separate and distinct handle portion as disclosed therein, have been available commercially for some time in various colors and, at least, some of them are manufactured of polyethylene. The musical tubes of which I am aware are uniformly corrugated, with the ridges and grooves of the corrugations lateral to the tube length, are light in weight, pliant, and measure an inch and a quarter in diameter and are about a yard long.

When swung around in the air, these flexible, corrugated tubes produce musical tones in the harmonic series, the particular note produced varying with the length of the tube. The notes ascend in pitch as the corrugated tube is swung harder and harder. There are some persons that have even mastered the instrument to the point that they can play a tune on it. The musical tones result, apparently, because air is sucked into the tube at the relatively immobile end being held and as it passes through the tube twoard the swinging end bounces off the non-smooth corrugated surface. The bouncing air sets up a standing wave which at certain frequencies plays the natural modes of the tube or the harmonic overtone series, the same notes that are on a bugle.

Various musical tones are produced, as above-indicated, by swinging the tube slower or faster, e.g., by swinging the musical tube very slowly, a low clear steady tone results. Swinging the musical tube at faster speeds creates other notes. The pitch is roughly translated into bumps per second. Doubling the velocity, i.e., by swinging the tube faster, raises the pitch an octave. With different lengths of corrugated tube, the pitch is raised and the modes changed. Accordingly, persons with different lengths of musical tube can create a musical group.

A disadvantage with the corrugated musical tubes such as are now commercially available, of which I am aware, is that they produce a rather muffled sound. As a matter of fact, the sound at times is so faint as to be almost inaudible. The reason for this, I have discovered, is because the ends of the musical tubes are either closed, or at least partially closed, e.g., the ends are of the more narrow diameter, i.e., the diameter of the valley of the corrugations, rather than of the larger diameter, as defined by the ridges of the corrugations.

Thus, by cutting the closed or partially closed ends of a commercially available musical tube so that the ends terminate at the apex of the ridge of a corrugation, a much more distinct and louder musical tone is produced on swinging. However, it is important to achieve this desired result that both ends of the musical tube be of this larger diameter.

A further disadvantage of the corrugated musical tubes now available commercially is that each particular, corrugated plastic tube is limited in the number of musical tones or sounds that can be produced. This results from the fact that the musical sounds resulting from any particular musical tube are predetermined by the particular length of tube.

Another disadvantage with musical tubes of which I am aware is that one end of the tube is slightly harder, i.e., less pliant, than the other. This results from the manner of manufacture of these tubes, i.e., by the blow molding process. The result is that, in the event one swings the musical tube by the relatively soft tube end, the tube breaks, after a while, intermediate the two ends but somewhat closer to the softer end being held. When this results, the musical tube is no longer useful and must be discarded. Moreover, as the break occurs during use, it presents a somewhat unsafe situation in that the tube end may become detached and fly through the air and hit an innocent bystander.

It has also been discovered that as the corrugated musical tubes now commercially available, at least of which I am aware, do not have predesignated in their construction a specific handle portion, users tend to cover over the end of the musical tube while holding it during use. This is particularly unsatisfactory as the tube operates by air being sucked into the tube, as above mentioned, at the end being held. Accordingly, if the end of the tube is closed off, even in part, by one's hand or palm, it does not produce the musical sounds intended.

SUMMARY OF THE INVENTION

In accordance with the basic aspects of my invention, there is provided a new and improved musical tube, not attendant with the above-mentioned disadvantages of the musical tubes according to the prior art. The musical tube of this invention comprises, in its more basic aspects, an elongated, one-piece, flexible, pliant, open-ended tube, the inner surface, at least, of which is a non-smooth surface and which has delimited at one end thereof, the relatively harder end in cases where the tube is blow molded, a specific handle portion. However, and this is critically important, the predesignated handle portion of the musical tube is delimited by only a narrow planar circumferential band and the handle portion remains of the same dimensions as the remainder of the tube.

While in the practice of my invention, I have used an elongated, flexible, corrugated, open-ended, cylindrical, plastic tube, manufactered by blow molding techniques, the musical tube of the invention need not be of this particular construction, or manufactured in such a fashion. The main consideration is that the inner surface of the tube wall be provided with turbulence and vibration producing projections or resistances so that when the stream of air passing through the tube impinges upon them, desirable musical sounds are produced.

Quite advantageously, the range of musical sounds that can be produced with such a musical tube is increased considerably by a further aspect of my invention which provides in combination an elongated musical tube and a musical reed. The reed of this combination is capable of various constructions, e.g., of circular or disc shape and of such a diameter that it can be secured, detachably if desired, into the end, the handle end is preferred, of the elongated, flexible musical tube. The disc, moreover, can be provided with more than one reed, if desired.

Another feature of this aspect of the invention is that the reed can be provided as an element of a shorter piece of elongated tube, at least part of which may be corrugated, which telescopes with the longer piece. Thus, with such a construction, it is possible to provide in a single musical tube, one which functions to create the various tones that would require a number of different musical tubes of various lengths. While the reed in this combination results in a musical instrument of a desirably wider range of musical sounds, the reed need not be used in all instances. A so-called "sliding" musical tube can be provided by combining with a musical tube a shorter length tube of a diameter which telescopes with the musical tube. Such a shorter length of tube need not be provided with any corrugations unless desired.

In still another feature of the invention, there is provided another combination of an elongated musical tube and a reed. With this construction, the reed body is in the form of a rectangular strip in which is provided a plurality of various reeds. The reed body is mounted on the elongated musical tube so that it can be moved transversely to the tube and thereby present different reeds to the air chamber. Thus, with such a reed, an elongated musical tube is provided that can produce a much wider variety of musical tones.

Quite advantageously, with the musical tube-reed combinations of the invention, a "one-man" band is possible. The invention, moreover, makes possible the production of various musical tones and in such a simple fashion, i.e., by motion of the tube, that any novice, even a child, can produce these musical tones.

BRIEF DESCRIPTION OF THE DRAWING

The invention will be best understood from the detailed description of the invention which follows hereafter, taken in connection with the appended drawings, in which:

FIG. 6 is a view of a combination musical tube/reed in which the reed is mounted to be moved laterally of the lengthwise direction of the musical tube;

FIG. 7 is an end view, in cross-section, of the combination musical tube/reed of FIG. 6 taken on secant lines 7—7;

FIG. 8 is an end view, in cross-section, taken at secant lines 8—8 in FIG. 9 showing still another configuration of reed and its mounting means that can be used in combination with the musical tube of the invention; and FIG. 9 is a side view showing the reed in FIG. 8 and the means for mounting the reed in combination with a musical tube.

DETAILED DESCRIPTION OF THE INVENTION AND THE PREFERRED EMBODIMENTS

Figure 1:
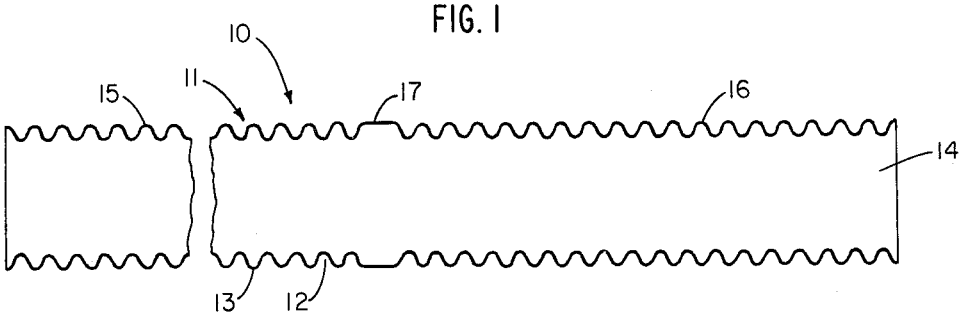
FIG. 1 is a side view showing an elongated, flexible, corrugated musical tube in accordance with the invention.

Turning now to the drawings, there is shown in FIG. 1 thereof a musical tube 10 according to the invention comprising an elongated, one-piece, flexible, pliant, corrugated, open-ended, cylindrical tube 11 comprising a series of uniform, alternating grooves 12 and ridges 13 along the entire length of the tube, except as hereinafter disclosed. The ends 14, 15 of the musical tube, as shown, terminate at the apex of a ridge thereby providing an end of maximum diameter. This is an important and critical feature to prevent the sounds to be produced by the musical tube from being muffled.

At one end of the tube, the right hand end in FIG. 1 of the drawing, is delimited a handle portion 16 by means of which musical tube 10 can be gripped in order to swing it to create the various musical sounds. Handle portion 16 of the musical tube is predesignated by means of a rather narrow planar circumferential band 17 that connects together two directly adjacent ridges. It is important that narrow band 17 be no wider than the distance between two adjacent ridges to provide a delimited handle portion, yet a tube of maximum flexibility and length. As the delimiting band is made wider, the rigidity of the musical tube increases. The result is that it effectively shortens the length of the tube. This is not desirable as it becomes harder to play the instrument and achieve the desired musical tones.

Handle portion 16 of the musical tube 10, as can be seen from the drawing, and this is an important feature of the invention, is also corrugated. The handle portion is also, and this is critical to prevent muffling of the sounds, of the same diameter as the remainder of the musical tube. Thus, the entire length of the tube, except for narrow band 17 comprises corrugations, lateral to the lengthwise direction of the tube, of uniform dimension and spacing.

Figure 2:
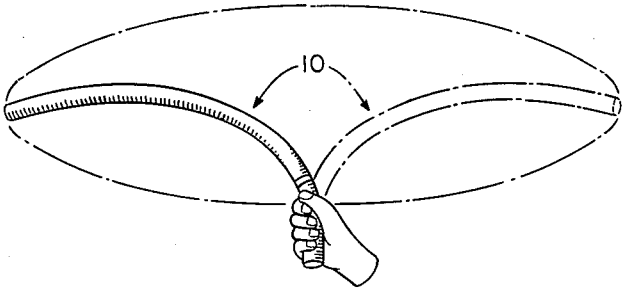
FIG. 2 is a view showing the musical tube of FIG. 1 held by hand and swirled around in the air in a somewhat rotary fashion to produce the musical tones desired.

To make music with musical tube 10, one grips handle portion 16 by the hand and swings it through the air as shown in FIG. 2. By merely swinging the musical tube through the air, abstract music can be created. However, by "feeling" for the notes, one can play the musical tube as does one play any musical instrument. The motion of the tube through the air apparently creates a vacuum and air is sucked into the tube at the handle end 14 and passes through the tube and out the moving end 15. The air in passing through the tube, or air chamber, is met by resistance caused by the non-smooth or corrugated, inner, circumferential surface. This results in the production of the musical tones. Various notes can be produced by swinging the musical tube slower or faster, e.g., by swinging the musical tube very slowly, a low clear steady tone results. The action is in the wrist. The key to producing any particular note is a steady rate of swing.

Figure 3:
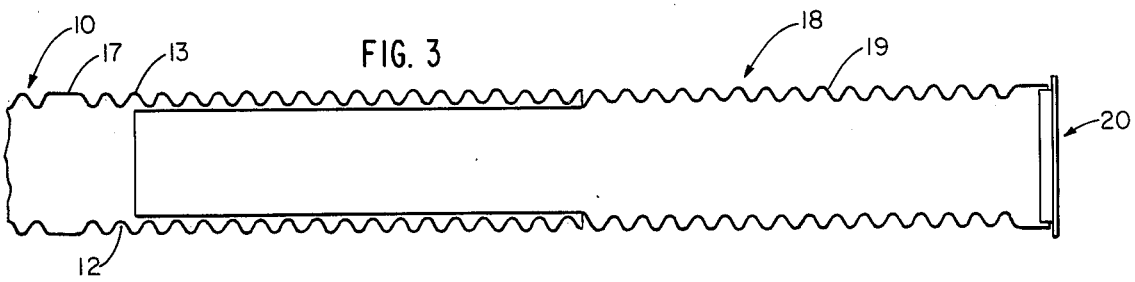
FIG. 3 is a side view of a musical tube in accordance with the invention in telescopic combination with a shorter length of tube only part of which is corrugated and in the end of which is located a reed.

Turning now to FIG. 3 of the drawing, there is shown therein the combination of an elongated musical tube 10 and an extension 18 of shorter length. As shown in the drawing, extension 18 is only partially corrugated, this being indicated by reference number 19. In the end of extension 18 is located a circular disc 20 comprising reeds 21, 22, 23, 24. As shown in the drawing, extension 18 also comprises uniform corrugations; however, one end of the extension is of a slightly lesser diameter than musical tube 10 so that extension 18 can be telescoped therewith. THe diameter of the smooth end of extension 18 should be such as to provide good frictional engagement between the outer surface of the extension and the inner surface of the musical tube. Thus, as extension 18 is capable of telescoping in and out with musical tube 10, a sliding musical tube is provided. This effectively provides a musical tube of various lengths. While extension 18, as shown in the drawing, is only partially corrugated, it will be appreciated that extension 18 can be entirely corrugated along its length, or not corrugated at all, i.e., provided with a smooth surface. Moreover, in some instances, it may be desirable to provide a sliding musical tube without benefit of a reed. Extension 18 can, of course, be entirely removed from the musical tube, if desired. However, with extension 18, a combination is provided that effectively provides a musical tube of various lengths.

Although, extension 18, as shown in FIG. 3, is seen to telescope into musical tube 10, it will be appreciated that extension 18, if desired, can be provided of a larger diameter so that musical tube 10 will telescope into the extension. Moreover, extension 18 can be provided of various lengths and where there is a corrugated section, this can also be shorter or longer as desired.

Figure 4:
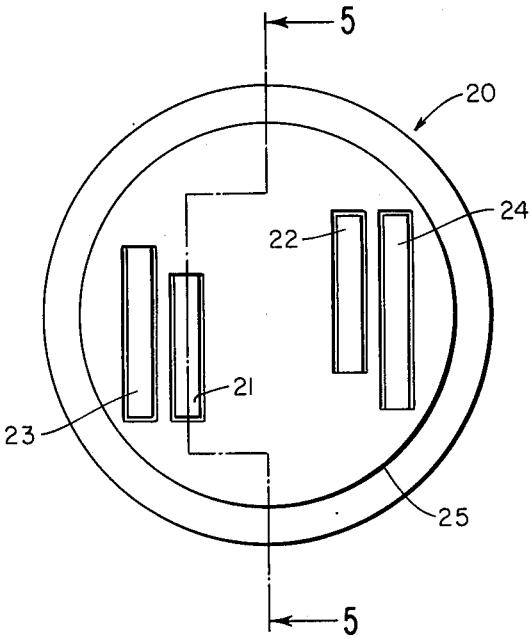
FIG. 4 is a plan view of the reed shown in the combination instrument of FIG. 3.
Figure 5:
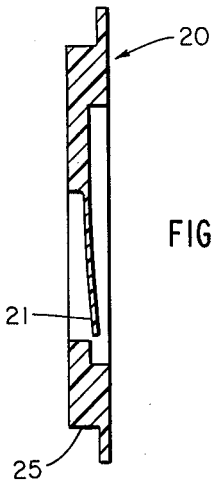
FIG. 5 is a view, in cross-section, of the reed in FIG. 4 taken at secant lines 5—5.

Disc 20 as shown more clearly in FIG. 4 of the drawing comprises a plurality of reeds 21, 22, 23, 24. Reeds 21, 22, as shown, are of the same dimension. Likewise, reeds 23, 24 are of the same width but of a different lengthwise dimension than reeds 21, 22. Those skilled in the musical art will appreciate that a different number of reeds could be provided, or reeds of different dimensions, in the practice of the invention. With the provision of different reeds, other and different sounds can be produced.

Disc 20 can be secured in the end of extension 18 by a number of different means depending on whether or not it is desired to secure it permanently in place. One means of securing the reed permanently in place is to fusion bond or adhesively bond it to the extension. If one desires a detachable reed, the rim 25 of disc 20 can be provided of such a diameter that it makes for a good press-fit into the end of extension 18 as shown in FIG. 3 of the drawing.

In FIG. 6 of the drawing, there is shown a further combination in accordance with the invention of an elongated musical tube 10 with a rectangular-shaped, musical instrument 26 which comprises reeds 27, 28, 29, 30, 31 and 32 (FIG. 7) of slightly varying lengths but of the same width. These reeds could, however, be of different widths if this is desired.

Musical instrument 26 is provided in combination with musical tube 10 by means of attachment 33 in which is provided two elongated openings 34, 35. Through these openings is passed musical instrument 26 in a direction as shown by the arrow. Thus, the various reeds 27, 28, 29, 30, 31 and 32 can be, as desired, presented to the flow of air entering into musical tube 10 to produce different sounds.

Attachment 33, as seen from the drawing comprises a short length of tubing which telescopes into the handle end 14 of musical tube 10. The diameter of this extension should be chosen so as to provide for good frictional engagement with musical tube 10. While attachment 33 is shown to have only a short telescoping section with musical tube 10, this section can be shorter or longer, as desired. As with extension 18, the telescoping section can be smooth or partially corrugated. In some instances, it may even be desirable that the telescoping section be entirely corrugated as is musical tube 10.

The musical instrument comprising the plurality of reeds such as in FIGS. 6, 7 need not be of rectangular configuration. In FIG. 8, there is shown a circular-shaped musical instrument 36 comprising a plurality of reeds 37, 38, 39 and 40 of various lengths. Musical instrument 36 is provided with a central opening 41 and is mounted for rotation, as indicated by the arrow, in mounting means 42. Mounting means 42, as shown in FIG. 9 of the drawing comprises end 43 of such diameter as to telescope into end 14 of musical tube 10. However, it can also be provided of a diameter so as to telescope into the end of extension 18, if this is desired.

Integral with telescoping end 43 of mounting means 42 is a somewhat larger diameter end 44 in which is rotatably mounted musical instrument 36. This is accomplished by means of projection 45 which fits into central opening 41 of musical instrument 36.

As will be appreciated, the musical tube of the invention, as well as extension 18, attachment 26 and mounting means 36 can be provided of various materials such as various plastic materials and synthetic rubbers. The olefin plastics such as polyethylene and polypropylene are particularly satisfactory for production of a flexible musical tube. Attachment 26 and mounting means 36 can be of more rigid material, if desired.

The musical tubes and accessories can be manufactured by various molding techniques; however, the preferred manner of manufacture of the musical tube is by blow molding. This technique in molding is well known and is believed to require no explanation herein. Musical tubes and extensions of various lengths and diameters can, of course, be provided. However, a corrugated tube about 36 inches long and having a maximum diameter, i.e., outside ridge diameter, of $1\frac{1}{4}$ inches will be found to perform quite satisfactorily. Moreover, such a musical tube will provide ease of handling and good flexibility. With such a musical tube, grooves having an outside diameter of 1 inch will be satisfactory. The thickness of the tube walls should be on the order of 1/32 inch, or probably less. The distance from mid-point to mid-point of adjacent ridges sould be uniform and measure about $\frac{1}{4}$ inch.

The reeds used in the practice of the invention can be of various materials, e.g. plastic, metal or wood. Their manner of manufacture depends somewhat on the material of construction chosen. A reed can be, for example, molded as a finished product or can be die-cut from a piece of plastic stock material.

The use of the combination musical tube/reed, if the reed is not positioned in an extension, is similar to that as shown in FIG. 2. However, in the case of the combination shown in FIG. 3, a sliding musical tube extension 18 can be telescoped into musical tube 10 more or less, as desired. The pitch of the musical sounds produced changes with use of the extension. The longer the overall length, the higher the pitch.

In the case of the musical tube/reed combination shown in FIG. 6, one grasps handle portion 16 with his right hand (assuming a right-handed person) and swirls it in the air in a rotary fashion as shown in FIG. 2. With the left hand, musical instrument 26 can be traversed back and forth across the air chamber as desired to produce various musical tones. A musical tube provided in combination with a musical instrument such as is disclosed in FIG. 8 is operated in a similar manner. The left hand is used to rotate musical instrument 36 to present the desired reed to the flow of incoming air.

It will be appreciated that while the musical reeds have herein been shown provided at the handle end, a reed such as is disclosed in FIG 4 can also, or instead of, be provided at the other end. However, this is less desirable as the musical sounds differ somewhat and moreover, the reed presents a potential safety hazard in that it could become disengaged from the tube and fly through the air hitting a bystander.

While the invention herein has been disclosed above more particularly as an elongated, corrugated, cylindrical, musical tube, it will be appreciated by those skilled in the art that it can take other structural forms. The main thing is that the inner surface of the tube be nonsmooth, i.e, comprise at least one, but preferably several, and of uniform size, shape and spacing, projections or resistances capable of resulting in the production of musical tones when air passes through the tube and impinges upon the projections.

These projections can take the form of merely a roughened, irregular surface, or they can be, for example, of a wave shape such as is provided by a corrugated surface. The surface can be saw-toothed or scalloped. The projections need not, however, be of uniform size or spacing, where a different musical sound is desired. The projections can take the form of a spiral ridge down the length of the tube. In another embodiment, the projection may be merely the result of varying thicknesses down the length of the tube, the outside surface of the tube being smooth and of the same outer diameter along its entire length.

The tubular shape need not be cylindrical in cross-section. It can be oval or of a polygonal shape. However, whatever the particular cross-sectional shape chosen, it is desirable that the outer dimension and shape be maintained uniformly throughout the entire length of the musical tube.

As many different embodiments of the invention will occur to those skilled in the art, it is to be understood that the specific embodiment of the invention as presented herein is intended by way of illustration only and not limiting upon the invention, but that the limitations thereon are to be determined only from the appended claims.

What I claim is:

1. A one-piece, elongated, pliant, flexible, open-ended tube of predetermined length having a first end and a second end and being capable of producing musical notes when held in one's hand and swung in a rotary fashion in the air wherein the tube is a corrugated plastic tube having an inner surface and an outer surface and being of predetermined inner and outer diameters, said inner surface comprising a series of interconnected parallel alternate grooves and ridges of uniform dimensions between the ends and along the length of the tube and lateral thereto, and a narrow planar band located between adajacent ridges of the tube and connecting these adjacent ridges together, said band being located near one end but spaced a distance therefrom along the length of the tube whereby to delimit a handle portion for holding the tube during use.

2. An elongated flexible tube according to claim 1 wherein the ends of the corrugated tube terminate at the apex of a groove whereby said ends are of maximum inner diameter.

3. An elongated flexible tube according to claim 1 wherein the plastic comprises polyethylene.

4. A one-piece, elongated, pliant, flexible, open-ended tube of predetermined length having a first end and a second end and being capable of producing musical notes when held in one's hand and swung in a rotary fashion in the air, said tube having an inner surface and an outer surface and being of predetermined inner and outer diameters, said inner surface comprising a series of interconnected parallel alternate grooves and ridges of uniform dimensions between the ends and along the length of the tube and lateral thereto, the inner diameters of said first and second end being at least as great as the maximum inner diameter along the tube length, and at one of the ends a handle portion delimited by a narrow planar annular band located adjacent said one end.

5. An elongated flexible tube according to claim 4 further comprising in combination with the tube, a musical instrument comprising a reed, said musical reed being located at the handle end of said tube so that incoming air will impinge upon it and create musical tones.

6. An elongated flexible tube according to claim 5 wherein the musical instrument comprising the reed is of a disc shape, said musical instrument being located transverse to the length of the tube.

7. An elongated flexible tube according to claim 4 further comprising a second but shorter tube length in telescopic combination with the elongated tube so as to provide a musical tube of varying lengths.

8. An elongated flexible tube according to claim 7 wherein a musical instrument comprising at least one reed is provided in one end of the shorter length tube.

9. An elongated flexible tube according to claim 8 wherein the musical instrument comprises a plurality of reeds of various lengths.

10. An elongated flexible tube according to claim 7 wherein the said second tube is of lesser predetermined length and diameter than the first elongated tube and telescopes into the flexible tube.

11. An elongated flexible tube according to claim 4 further comprising a musical instrument having a rectangular shape and comprising reeds therein of different lengths, and means for attaching the said musical instrument to the handle end of said elongated tube whereby the musical instrument can be moved transversely across the path of incoming air as desired to produce various musical tones.

12. An elongated, flexible corrugated tube according to claim 11 wherein the means for attaching the reed comprises a relatively short tube of slightly lesser diameter than the elongated tube but providing good frictional engagement with the elongated tube so as not to become accidentally disengaged, said short tube overlapping with the end of the elongated tube but extending for a short distance from the end of the elongated tube, opposed elongated openings in the said short tube for insertion and holding of the musical instrument comprising the reeds in a direction transverse to the length of the tube, said musical instrument being capable of back and forth movement across the middle of the incoming air stream on operation of the tube as a musical tube.

* * * * *